US012179077B2

(12) United States Patent
Ines et al.

(10) Patent No.: US 12,179,077 B2
(45) Date of Patent: Dec. 31, 2024

(54) INTERNALLY DAMPED GOLF CLUB HEAD

(71) Applicant: Acushnet Company, Fairhaven, MA (US)

(72) Inventors: Marni D. Ines, San Marcos, UT (US); Gery M. Zimmerman, Fallbrook, CA (US)

(73) Assignee: ACUSHNET COMPANY, Fairhaven, MA (US)

( * ) Notice: Subject to any disclaimer, the term of this patent is extended or adjusted under 35 U.S.C. 154(b) by 84 days.

(21) Appl. No.: 17/812,590

(22) Filed: Jul. 14, 2022

(65) Prior Publication Data

US 2024/0017143 A1 Jan. 18, 2024

(51) Int. Cl.
*A63B 53/04* (2015.01)
*A63B 60/54* (2015.01)

(52) U.S. Cl.
CPC ..... *A63B 60/54* (2015.10); *A63B 53/0475* (2013.01); *A63B 53/0466* (2013.01); *A63B 2053/0479* (2013.01); *A63B 2209/00* (2013.01)

(58) Field of Classification Search
CPC .. A63B 60/54; A63B 53/0475; A63B 2209/00
See application file for complete search history.

(56) References Cited

U.S. PATENT DOCUMENTS

| | | | |
|---|---|---|---|
| 1,133,129 | A | 3/1915 | Govan |
| 2,077,377 | A | 4/1937 | Link |
| 2,111,249 | A | 3/1938 | Plese |
| 3,817,522 | A | 6/1974 | Simmons |
| 4,195,842 | A | 4/1980 | Coleman |
| 4,398,965 | A | 8/1983 | Campau |
| 4,754,977 | A | 7/1988 | Sahm |
| 4,811,950 | A | 3/1989 | Kobayashi |
| 4,826,172 | A | 5/1989 | Antonious |
| 4,928,972 | A | 5/1990 | Nakanishi |
| 4,938,470 | A | 7/1990 | Antonious |
| 5,048,835 | A | 9/1991 | Gorman |
| 5,056,788 | A | 10/1991 | Katayama |
| 5,121,922 | A | 6/1992 | Harsh, Sr. |
| 5,184,823 | A | 2/1993 | Desboilles |
| 5,261,664 | A | 11/1993 | Anderson |
| 5,290,032 | A | 3/1994 | Fenton |
| 5,316,298 | A | 5/1994 | Hutin |
| 5,326,047 | A | 7/1994 | Shaw et al. |

(Continued)

FOREIGN PATENT DOCUMENTS

| | | |
|---|---|---|
| JP | 03007178 A | 1/1991 |
| JP | H11-192329 | 5/2001 |

(Continued)

*Primary Examiner* — William M Pierce
(74) *Attorney, Agent, or Firm* — Lewis Roca Rothgerber Christie LLP

(57) ABSTRACT

A golf club head includes a striking face including an exterior surface having a lower leading edge and an opposite upper topline edge, and an interior surface opposite to the exterior surface; a sole extending from the lower leading edge and having a rearward portion opposite to the lower leading edge; a back portion coupled between the upper topline edge and the rearward portion; a cavity at least partially enclosed by the striking face, the sole, and the back portion; and at least one constrained damping layer on the interior surface of the striking face.

20 Claims, 5 Drawing Sheets

(56) References Cited

U.S. PATENT DOCUMENTS 5,328,184 A 7/1994 Antonious
5,346,213 A 9/1994 Yamada
5,398,929 A 3/1995 Kitaichi
5,403,007 A 4/1995 Chen
5,464,211 A 11/1995 Atkins, Sr.
5,492,327 A 2/1996 Biafore, Jr.
5,499,814 A 3/1996 Lu
5,505,453 A 4/1996 Mack
5,529,543 A 6/1996 Beaumont, Sr.
5,547,194 A 8/1996 Aizawa
5,547,427 A 8/1996 Rigal
5,586,947 A 12/1996 Hutin
5,586,948 A 12/1996 Mick
5,588,923 A 12/1996 Schmidt
5,626,530 A 5/1997 Schmidt
5,628,697 A 5/1997 Gamble
5,669,829 A 9/1997 Lin
5,697,855 A 12/1997 Aizawa
5,766,092 A 6/1998 Mimeur
5,830,084 A 11/1998 Kosmatka
5,833,551 A 11/1998 Vincent
5,888,148 A 3/1999 Allen
5,890,973 A 4/1999 Gamble
5,899,821 A 5/1999 Hsu
5,971,868 A 10/1999 Kosmatka
6,001,030 A 12/1999 Delaney
6,015,354 A 1/2000 Ahn
6,042,486 A 3/2000 Gallagher
6,162,133 A 12/2000 Peterson
6,165,081 A 12/2000 Chou
6,200,228 B1 3/2001 Takeda
D444,195 S 6/2001 Wahl
6,299,547 B1 10/2001 Kosmatka
6,299,549 B1 10/2001 Shieh
6,306,048 B1 10/2001 McCabe
6,309,311 B1 10/2001 Lu
6,364,789 B1 4/2002 Kosmatka
6,508,722 B1 1/2003 McCabe
6,595,870 B2 7/2003 Stites
6,695,715 B1 2/2004 Chikaraishi
D489,106 S 4/2004 Wahl
6,719,641 B2 4/2004 Dabbs
6,832,961 B2 12/2004 Sano
6,835,144 B2 12/2004 Best
6,855,066 B2 2/2005 Best
6,887,164 B2 5/2005 Danwaniee
6,902,495 B2 6/2005 Pergande
6,921,344 B2 7/2005 Gilbert
6,964,620 B2 11/2005 Gilbert
6,976,924 B2 12/2005 Gilbert
6,991,559 B2 * 1/2006 Yabu ..... A63B 53/04 473/409
7,008,331 B2 3/2006 Chen
7,056,229 B2 6/2006 Chen
7,096,558 B2 8/2006 Sano
7,140,977 B2 11/2006 Atkins, Sr.
7,160,204 B2 1/2007 Huang
7,169,057 B2 1/2007 Wood et al.
7,211,006 B2 5/2007 Chang
7,247,104 B2 7/2007 Poynor
7,371,190 B2 5/2008 Gilbert
7,387,579 B2 6/2008 Lin
7,476,162 B2 * 1/2009 Stites ..... A63B 60/00 473/332
7,559,853 B2 7/2009 Hirano
7,575,523 B2 8/2009 Yokota
7,578,755 B2 8/2009 Oyama
7,582,024 B2 9/2009 Shear
7,588,503 B2 9/2009 Roach
7,591,735 B2 9/2009 Matsunaga
7,597,633 B2 10/2009 Shimazaki
7,604,550 B1 10/2009 Currie
7,662,050 B2 * 2/2010 Gilbert ..... A63B 53/047 473/332
7,686,706 B2 3/2010 Matsunaga
7,713,141 B2 * 5/2010 Yamamoto ..... A63B 60/54 473/332
7,731,604 B2 6/2010 Wahl
7,749,100 B2 7/2010 Tavares
7,753,806 B2 7/2010 Beach
7,785,212 B2 8/2010 Lukasiewicz, Jr.
7,798,913 B2 9/2010 Noble
7,871,338 B2 1/2011 Nakano
7,878,920 B2 2/2011 Clausen
7,892,106 B2 2/2011 Matsunaga
7,935,000 B2 5/2011 Stites
7,967,700 B2 6/2011 Stites
8,088,025 B2 1/2012 Wahl
8,157,673 B2 4/2012 Gilbert
8,187,116 B2 5/2012 Boyd
8,210,961 B2 7/2012 Finn
8,210,965 B2 7/2012 Roach
8,267,807 B2 9/2012 Takechi
8,277,337 B2 10/2012 Shimazaki
8,328,663 B2 12/2012 Wahl
8,333,667 B2 12/2012 Kumamoto
8,348,782 B2 1/2013 Park
8,353,784 B2 1/2013 Boyd
8,403,771 B1 3/2013 Rice
8,403,774 B2 3/2013 Stites
8,517,863 B2 8/2013 Wahl
8,535,176 B2 9/2013 Bazzel
8,562,652 B2 10/2013 Biedermann
8,608,585 B2 12/2013 Stites
8,696,489 B2 4/2014 Gibbs
8,753,219 B2 6/2014 Gilbert
8,753,228 B2 6/2014 Golden
8,758,159 B2 6/2014 Morin
8,814,725 B2 8/2014 Wahl
8,821,307 B2 9/2014 Park
8,864,603 B2 10/2014 Kumamoto
8,920,261 B2 12/2014 Taylor et al.
8,961,336 B1 2/2015 Parsons et al.
9,011,266 B2 4/2015 Brunski
9,039,543 B2 5/2015 Mizutani
9,101,809 B2 8/2015 Gibbs
9,211,451 B1 * 12/2015 Westrum ..... A63B 60/42
9,265,995 B2 2/2016 Wahl
9,457,241 B2 10/2016 Hebreo
9,586,104 B2 * 3/2017 Roach ..... A63B 60/02
9,597,562 B2 3/2017 Dipert
9,662,549 B2 5/2017 Vrska, Jr.
9,849,354 B2 12/2017 Stokke
9,993,699 B2 6/2018 Larson
9,993,704 B2 6/2018 Hebreo
10,039,965 B1 8/2018 Seluga
10,086,244 B2 10/2018 Morin
10,150,019 B2 12/2018 Ines
10,220,272 B2 3/2019 Gonzalez
10,293,226 B2 5/2019 Hebreo
10,471,319 B1 11/2019 Mata
10,625,127 B2 4/2020 Golden
10,821,338 B2 * 11/2020 Hebreo ..... A63B 53/047
10,821,344 B2 11/2020 Mata
11,020,639 B2 * 6/2021 Golden ..... A63B 53/047
11,090,532 B2 8/2021 Wahl
11,090,534 B2 8/2021 Westrum
11,202,946 B2 * 12/2021 Golden ..... A63B 60/54
2003/0092502 A1 5/2003 Pergande
2003/0190975 A1 10/2003 Fagot
2005/0009624 A1 1/2005 Long
2005/0107183 A1 5/2005 Takeda
2005/0137024 A1 * 6/2005 Stites ..... A63B 53/047 473/291
2005/0277485 A1 12/2005 Hou
2007/0026961 A1 2/2007 Hou
2007/0135233 A1 7/2007 Perras
2008/0004131 A1 1/2008 Lin
2008/0305888 A1 12/2008 Tseng
2009/0163295 A1 6/2009 Tseng
2009/0247314 A1 10/2009 Matsunaga
2010/0056296 A1 3/2010 Kumamoto
2010/0056297 A1 3/2010 Roach
2010/0273565 A1 10/2010 Stites

(56) References Cited

U.S. PATENT DOCUMENTS

| | | | | |
|---|---|---|---|---|
| 2011/0124432 | A1 | 5/2011 | Oldknow | |
| 2011/0159981 | A1 | 6/2011 | Bazzel | |
| 2011/0250985 | A1 | 10/2011 | Stites | |
| 2012/0064997 | A1 | 3/2012 | Sato | |
| 2012/0172144 | A1 | 7/2012 | Mazutani | |
| 2013/0130827 | A1 | 5/2013 | Boyd | |
| 2013/0324297 | A1 | 12/2013 | Larson | |
| 2015/0165280 | A1 | 6/2015 | Hebreo | |
| 2015/0343281 | A1 | 12/2015 | Ban | |
| 2016/0038795 | A1* | 2/2016 | Kline | A63B 53/047 473/334 |
| 2016/0271460 | A1* | 9/2016 | Dolezel | A63B 53/047 |
| 2017/0144037 | A1 | 5/2017 | Dipert | |
| 2017/0333765 | A1 | 11/2017 | Parsons | |
| 2018/0028882 | A1 | 2/2018 | Hebreo | |
| 2018/0028883 | A1 | 2/2018 | Morin | |
| 2018/0133565 | A1 | 5/2018 | Hebreo | |
| 2019/0151722 | A1 | 5/2019 | Gonzalez | |
| 2021/0046363 | A1* | 2/2021 | Golden | A63B 53/06 |
| 2021/0106887 | A1* | 4/2021 | Gonzalez | A63B 53/0475 |
| 2021/0121748 | A1* | 4/2021 | Ines | A63B 53/06 |
| 2021/0236887 | A1 | 8/2021 | Demkowski | |
| 2022/0118328 | A1 | 4/2022 | Golden et al. | |
| 2023/0201678 | A1* | 6/2023 | Wada | A63B 53/06 473/345 |

FOREIGN PATENT DOCUMENTS

| | | |
|---|---|---|
| JP | 2001-170222 | 6/2001 |
| JP | 2003284794 | 10/2003 |
| JP | 2006-000139 | 1/2006 |
| JP | 2007-21171 | 1/2007 |
| JP | 2009-61317 | 3/2009 |
| JP | 2009240365 | 10/2009 |
| JP | 2015-517882 | 6/2015 |

* cited by examiner

INTERNALLY DAMPED GOLF CLUB HEAD

CROSS-REFERENCE TO RELATED APPLICATION

This application is related to U.S. application Ser. No. 17/565,895, filed on Dec. 30, 2021, published as U.S. Patent Publication No. 2022/0118328 on Apr. 21, 2022, the entire content of which is hereby incorporated by reference.

BACKGROUND

Golf club heads having a hollow construction and a high coefficient of restitution (COR) may produce, when hitting a golf ball, a sound and feel that is considered to be undesirable. The sound and feel may be improved by providing the golf club head with internal damping. Such internal damping may include filling the golf club head with a filler material, such as a polymer or a foam, or including a damping element in the golf club head between an interior surface of a striking face of the golf club head and a support arm inside the golf club head. However, such internal damping increases the mass of the golf club head, which may be undesirable. As such, improvements in internal damping for golf club heads are desired.

It is with respect to these and other general considerations that the aspects disclosed herein have been made. Also, although relatively specific problems may be discussed, it should be understood that the examples should not be limited to solving the specific problems identified in the background or elsewhere in this disclosure.

SUMMARY

In an aspect, the technology relates to a golf club head, including: a striking face having an exterior surface having a lower leading edge and an opposite upper topline edge, and an interior surface opposite to the exterior surface; a sole extending from the lower leading edge and having a rearward portion opposite to the lower leading edge; a top portion extending from the upper topline edge; a back portion coupled between the top portion and the rearward portion of the sole; a cavity at least partially enclosed by the striking face, the sole, and the back portion; a support arm extending at least partially through the cavity from at least one of the top portion, the back portion, or the sole; a damping element positioned between the support arm and the interior surface of the striking face and contacting both of the support arm and the interior surface of the striking face; and a first constrained damping layer on the interior surface of the striking face and spaced apart from the damping element.

In an example, the golf club head further includes a second constrained damping layer on the interior surface of the striking face and spaced apart from the first constrained damping layer. In an example, the first constrained damping layer is at least partially positioned between the damping element and a toe of the golf club head, and the second constrained damping layer is at least partially positioned between the damping element and a heel of the golf club head. In an example, an area of the interior surface of the striking face covered by the first constrained damping layer is 1.1 to 1.5 times an area of the interior surface of the striking face covered by the second constrained damping layer. In an example, a first surface of the first constrained damping layer faces the interior surface of the striking face, and a second surface of the first constrained damping layer opposite to the first surface is exposed to the cavity. In an example, the support arm extends at least partially through the cavity from the top portion or from the sole, and wherein the damping element overlaps a center of the striking face. In an example, the support arm extends at least partially through the cavity from the back portion, and the damping element overlaps a center of the striking face.

In another aspect, the technology relates to a golf club head, including: a striking face including an exterior surface having a lower leading edge and an opposite upper topline edge, and an interior surface opposite to the exterior surface; a sole extending from the lower leading edge and having a rearward portion opposite to the lower leading edge; a back portion coupled between the upper topline edge and the rearward portion; a cavity at least partially enclosed by the striking face, the sole, and the back portion; a first constrained damping layer on the interior surface of the striking face; and a second constrained damping layer on the interior surface of the striking face and spaced apart from the first constrained damping layer.

In an example, the golf club head further includes a third constrained damping layer on the interior surface of the striking face and spaced apart from the first and second constrained damping layers. In another example, the third constrained damping layer overlaps a center of the striking face, the first constrained damping layer is at least partially between the third constrained damping layer and a toe of the golf club head, and the second constrained damping layer is at least partially between the third constrained damping layer and a heel of the golf club head. In another example, the first and second constrained damping layers are each spaced apart within the cavity from the back portion. In another example, the first and second constrained damping layers each includes a stiffening plate attached to the interior surface of the striking face by an adhesive. In another example, an area of the interior surface of the striking face covered by the first constrained damping layer is different from an area of the interior surface of the striking face covered by the second constrained damping layer. In another example, a portion of the interior surface of the striking face between the first and second constrained damping layers is exposed to the cavity.

In another aspect, the technology relates to a golf club head, including: a striking face including an exterior surface having a lower leading edge and an opposite upper topline edge, and an interior surface opposite to the exterior surface; a sole extending from the lower leading edge and having a rearward portion opposite to the lower leading edge; a back portion coupled between the upper topline edge and the rearward portion; a cavity at least partially enclosed by the striking face, the sole, and the back portion; and a constrained damping layer on the interior surface of the striking face and spaced apart from a center of the striking face.

In an example, a first surface of the constrained damping layer faces the interior surface of the striking face and a second surface of the constrained damping layer opposite to the first surface is exposed to the cavity. In another example, the constrained damping layer includes a stiffening plate attached to the interior surface of the striking face by an adhesive. In another example, the stiffening plate includes aluminum or carbon fiber. In another example, the constrained damping layer is disc-shaped. In another example, the constrained damping layer has a lower edge shaped to correspond to a portion of the lower leading edge that the constrained damping layer is adjacent to, and an upper edge opposite to the lower edge and shaped to correspond to a portion of the upper topline edge that the constrained damping layer is adjacent to.

This summary is provided to introduce a selection of concepts in a simplified form that are further described below in the Detailed Description. This summary is not intended to identify key, critical, or essential features of the claimed subject matter, nor is it intended to be used to limit the scope of the claimed subject matter.

BRIEF DESCRIPTION OF THE DRAWINGS

Non-limiting and non-exhaustive examples are described with reference to the following figures.

DETAILED DESCRIPTION

The technologies described herein contemplate a golf club head, such as a metal wood, a hybrid, or an iron, such as a wedge, that has internal damping to improve a sound and feel of the golf club head when hitting a golf ball.

Figure 1:
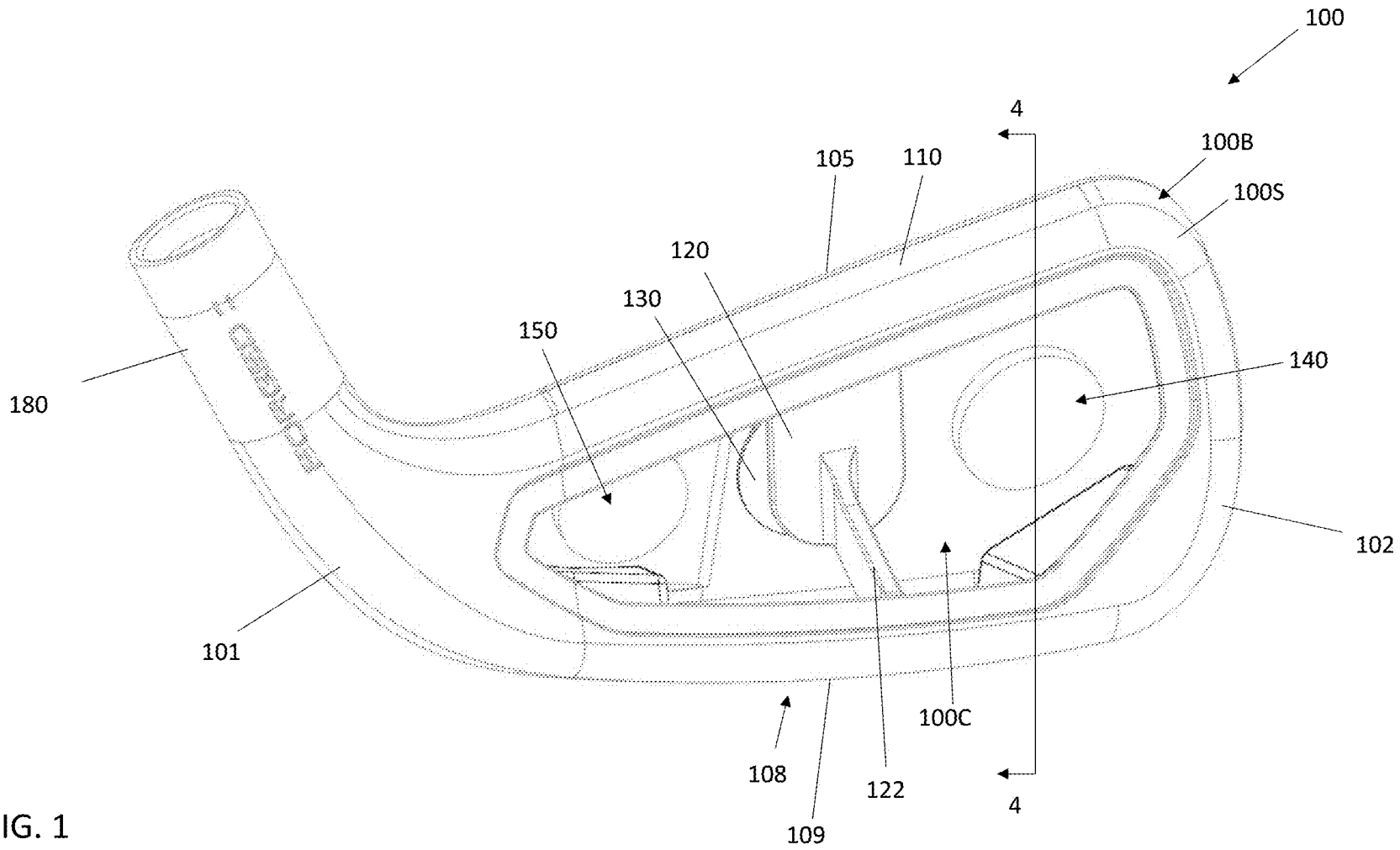
FIG. 1 depicts a back view of a golf club head without part of a back portion of the golf club head according to some examples.
Figure 2:
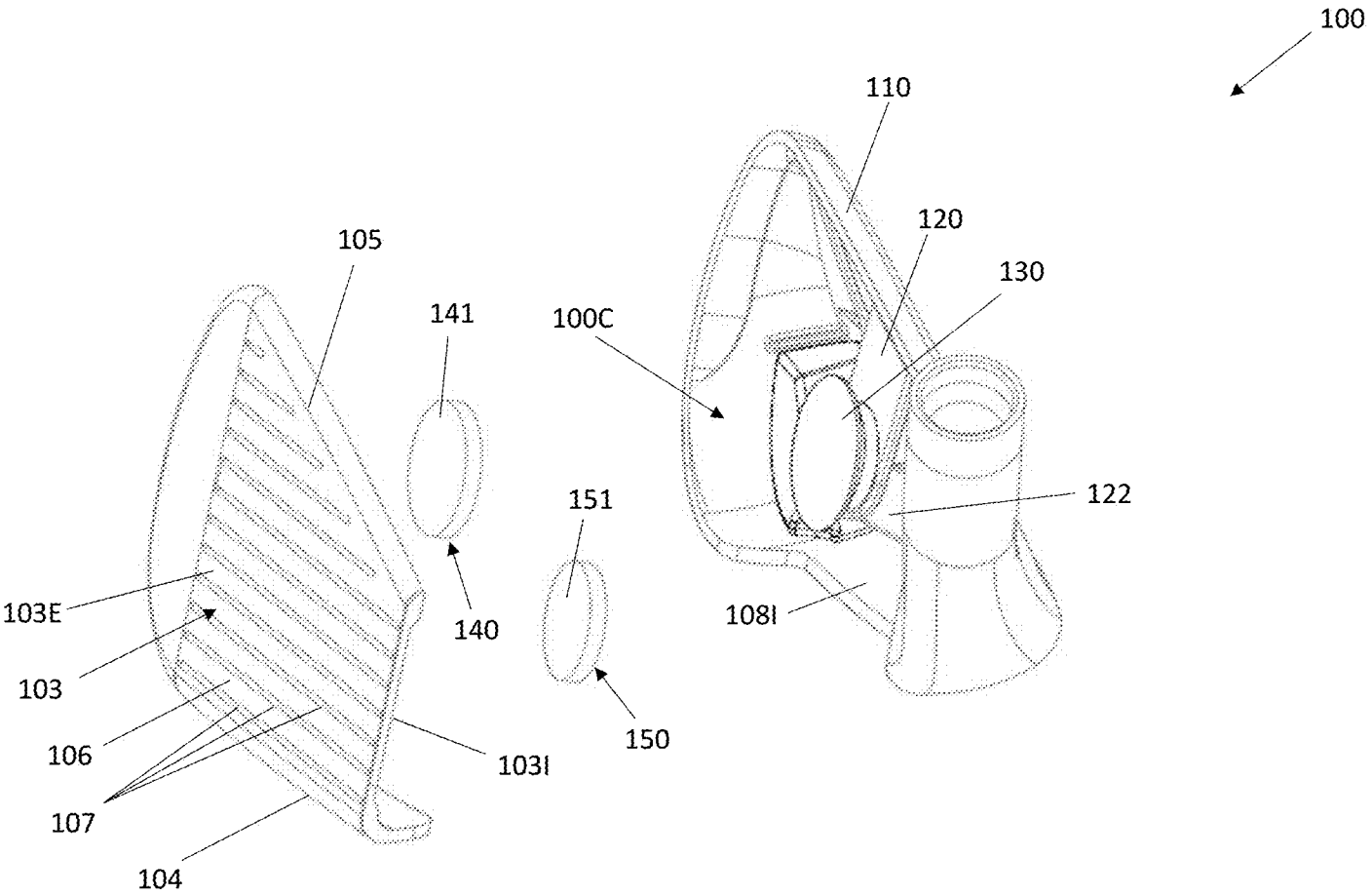
FIG. 2 depicts a partially exploded perspective view of the golf club head of FIG. 1.
Figure 3:
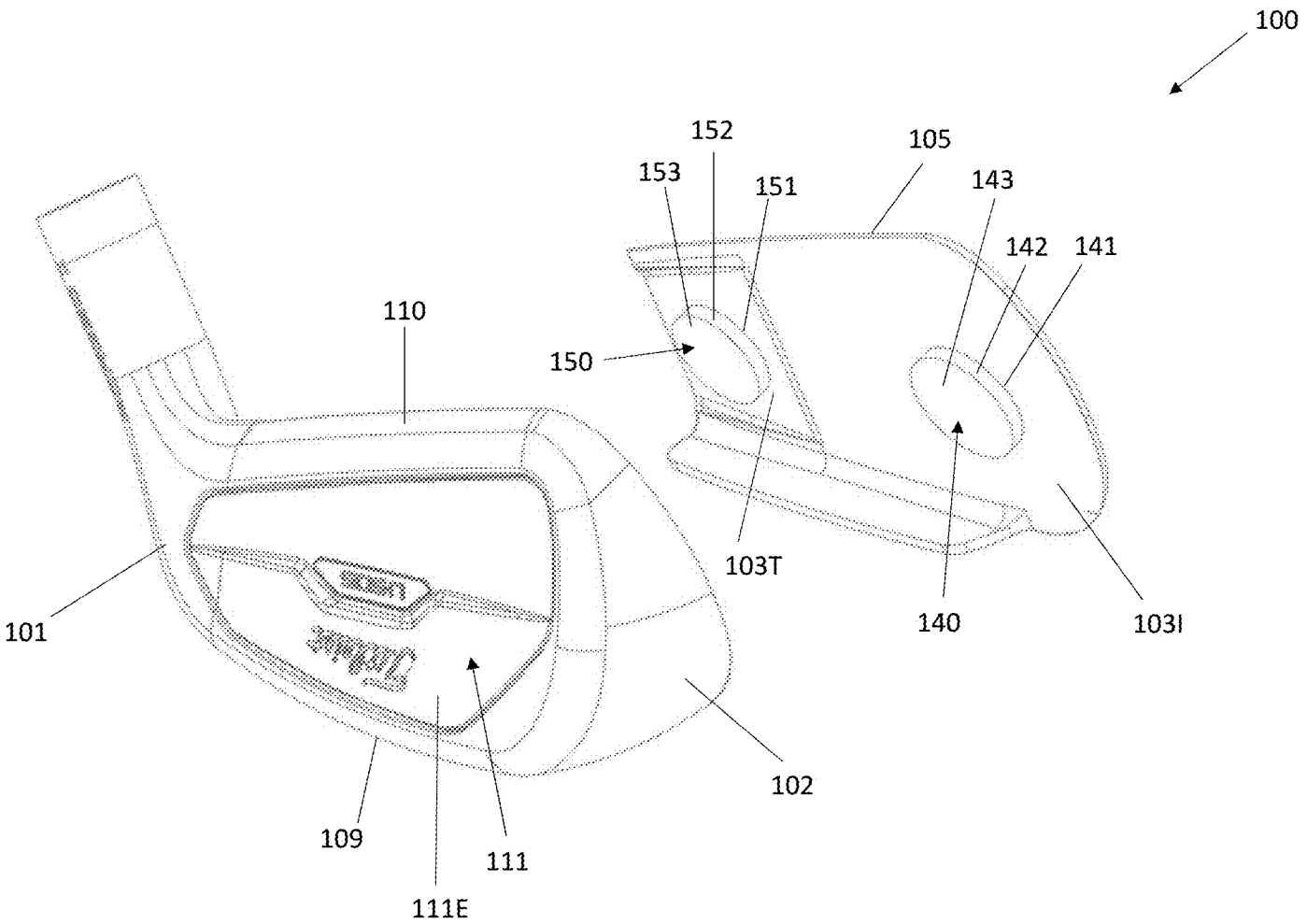
FIG. 3 depicts another partially exploded perspective view of the golf club head of FIG. 1.
Figure 4:
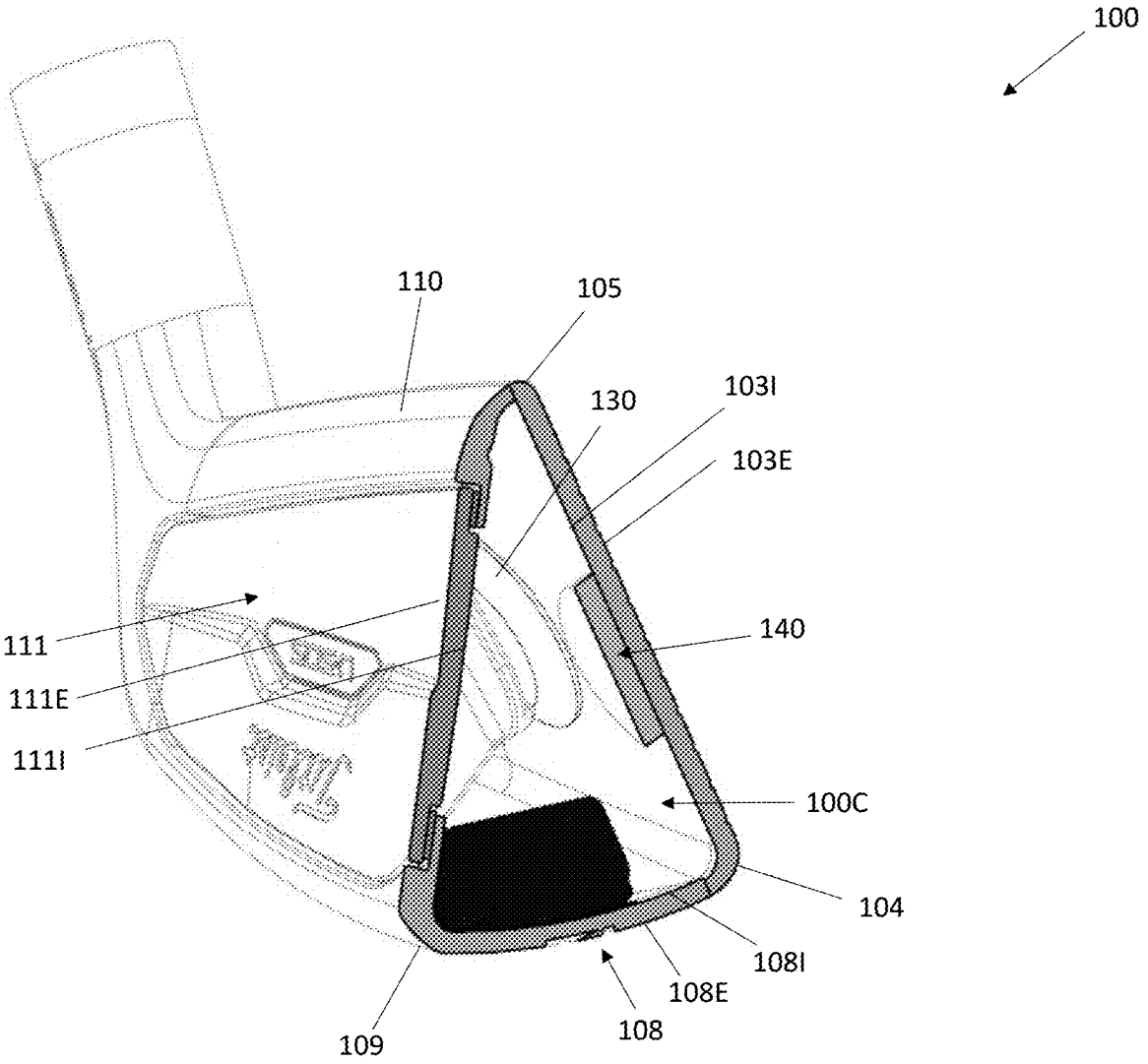
FIG. 4 depicts a cross-sectional view of the golf club head of FIG. 1 along line 4-4 of FIG. 1.

FIG. 1 depicts a back view of a golf club head 100 without part of a back portion 111 of the golf club head 100 according to some examples. In particular, FIG. 1 depicts an iron type golf club head 100. FIG. 2 depicts a partially exploded perspective view of the golf club head 100 of FIG. 1. FIG. 3 depicts another partially exploded perspective view of the golf club head 100 of FIG. 1. FIG. 4 depicts a cross-sectional view of the golf club head 100 of FIG. 1 along line 4-4 of FIG. 1.

Referring concurrently to FIGS. 1-4, a golf club head 100 may include a body 100B having an outer surface 100S. The body 100B may include a heel 101, a toe 102, a striking face 103 coupled between the heel 101 and toe 102 and having a lower leading edge 104 and an upper topline edge 105 opposite to the lower leading edge 104, a sole 108 extending from the lower leading edge 104 and having a rearward portion 109 opposite to the lower leading edge 104, a top portion 110 extending rearward from the upper topline edge 105, and a back portion 111 coupled between the rearward portion 109 and the top portion 110. In some examples, the top portion 110 is omitted, and the back portion 111 is coupled between the rearward portion 109 and the upper topline edge 105. The back portion 111 may include all portions of the outer surface 100S of the body 100B that are both coupled between the rearward portion 109 and the top portion 110 (or the upper topline edge 105 in examples where the top portion 110 is omitted) and coupled between the heel 101 and the toe 102. The golf club head 100 may include a hosel 180 at the heel 101 that may be coupled to a golf club shaft (not shown).

The striking face 103 (see FIG. 2) may be configured to strike a golf ball and may have an exterior surface 103E facing outside the golf club head 100 and an interior surface 103I opposite to the exterior surface 103E. The exterior surface 103E of the striking face 103 may include an outermost surface 106 and a plurality of grooves (or score lines) 107 extending in a toe heel 101 direction and arranged with each other along a direction extending from the lower leading edge 104 to the upper topline edge 105. As used herein, a toe-heel direction refers to both a toe-to-heel direction and a heel-to-toe direction. The exterior surface 103E of the striking face 103 may provide a portion of the outer surface 100S of the body 100B of the golf club head 100. The striking face 103 may include a thinned portion 103T proximal to the heel 101. The thinned portion 103T may have a smaller thickness than an adjacent portion (e.g., the remainder) of the striking face 103, and may be provided as a tapered recess in the interior surface 103I of the striking face 103 so that the striking face 103 generally gets thinner in the toe-to-heel direction. The mass of the golf club 100 may be reduced by providing the thinned portion 103T in the striking face 103.

The sole 108 may have an exterior surface 108E facing the outside of the golf club head 100 and an interior surface 108I opposite to the exterior surface 108E. In operation, the sole 108 may generally provide the lower surface of the golf club head 100 when the golf club head 100 is placed in an address position. The address position, as defined by the current application, sets up the golf club head at an orientation that has a lie angle of 60 degrees similar to the requirements of the USGA. Once the lie angle is set at 60 degrees, a face angle of the golf club head is set to be square, which is defined as having a face angle of 0 degrees. The exterior surface 108E of the sole 108 may provide a portion of the outer surface 100S of the body 100B of the golf club head 100.

The back portion 111 may have an exterior surface 111E facing the outside of the golf club head 100 and an interior surface 111I opposite to the exterior surface 111E. In some examples, the golf club head may be a metal wood or a hybrid including a striking face and a sole having features similar to the striking face 103 and the sole 108 described herein, and may further include a crown coupled between the rearward portion of the sole (or "skirt" of the metal wood or hybrid golf club head) and the upper topline edge of the striking face. In some such examples, the crown may have an exterior surface facing the outside of the golf club head and an interior surface opposite to the exterior surface. The exterior surface 111E of the back portion 111 (or the exterior surface of the crown in examples where the golf club head is a metal wood or a hybrid) may provide a portion of the outer surface 100S of the body 100B of the golf club head 100.

The golf club head 100 may have a cavity 100C at least partially enclosed by the striking face 103, the sole 108, and the back portion 111 (or the crown, in examples where the golf club head is a metal wood or hybrid). For example, at least part (e.g., part or all) of the interior surface 103I of the striking face 103, at least part of the interior surface 108I of the sole 108, and at least part of the interior surface 111I of the back portion 111 (or interior surface of the crown, in examples where the golf club head is a metal wood or hybrid) may face the cavity 100C. In some examples, the cavity 100C is at least partially defined by one or more of the top portion 110, the heel 101, and the toe 102. The cavity 100C may be hollow and filled with air or another gas, but the present disclosure is not limited thereto. For example, in some examples, the cavity 100C may be at least partially filled with a foam or a lightweight polymer.

In some examples, at least one damping element 130 is positioned between the interior surface 103I of the striking face 103 and a support arm 120. The golf club head 100 may further include a first constrained damping layer 140 on the interior surface 103I of the striking face 103 and a second constrained damping layer 150 on the interior surface 103I of the striking face 103.

The first and second constrained damping layers 140 and 150 and the damping element 130 provide internal damping for the golf club head 100 to improve the sound and feel of the golf club head 100 when hitting a golf ball. However, unlike the damping element 130, which is positioned between the striking face 103 and the support arm 120, the first and second constrained damping layers 140 and 150 may be attached to the interior surface 103I of the striking face 103 without support arms being positioned behind them within the cavity 100C. Accordingly, the constrained damping layers 140 and 150 may provide a more mass-efficient manner of internal damping for the golf club head 100 than the damping element 130 or by filling the cavity 100C with a damping filler material. Furthermore, because the constrained damping layers 140 and 150 may be separately manufactured and then attached to the interior surface 1301 of the striking face, the constrained damping layers 140 and 150 may provide a simpler manner for providing internal damping than the damping element 130, which may require the golf club head 100 to be manufactured to include the support arm 120. However, the constrained damping layers 140 and 150 may be used with the damping element 130 in some examples in order to suitably control internal damping. For example, using the constrained damping layers 140 and 150 in conjunction with the damping element 130 may provide better internal damping than using the damping element 130 without the constrained damping layers 140 and 150 or using the constrained damping layers 140 and 150 without the damping element 130.

The damping element 130 may contact (e.g., directly contact) each of the interior surface 103I of the striking face 103 and the support arm 120. The damping element 130 may include any suitable material, for example, a polymer. Additional examples of materials suitable for damping element 130 may be found in U.S. Patent Publication No. 2022/0118328, the disclosure of which is incorporated herein by reference in its entirety. In some examples, the damping element 130 is an elastomer element. The damping element 130 may be different in material than at least one of the striking face 103 or the support arm 120. The damping element 130 may have any suitable shape, such as a disc-shape, and may overlap a center of the striking face 103. In examples, the "center" of the striking face 103 may refer, on exterior surface 103E, to the center of the fifth groove 107 from the lower leading edge 104 toward the upper topline edge 105. Further, "overlap the center of the striking face" includes overlapping a point on the interior surface 103I of the striking face 103 that is directly opposite the center of the striking face 103 measured on exterior surface 103E. In some examples, the damping element 130 is provided as a discrete element within the cavity 100C, for example, spaced apart from at least one (or all) of the sole 108, the back portion 111, or the top portion 110.

The support arm 120 may extend at least part way through the cavity 100C from at least one of the top portion 110, the back portion 111, or the sole 108. In the example depicted in FIGS. 1-4, the support arm 120 extends part way through the cavity 100C from the top portion 110. In some examples, the support arm 120 may extend all the way through the cavity 100C, for example, from the top portion 110 to the sole 108. In some other examples, the support arm 120 may extend part way through the cavity 100C from the sole 108 or from the back portion 111.

A stiffening arm 122 may extend at least part way through the cavity 100C from at least one of the top portion 110, the back portion 111, or the sole 108 to contact the support arm 120. For example, the stiffening arm 122 may contact a side of the support arm 120 opposite to a side of the support arm 120 in contact with the damping element 130. By interposing the stiffening arm 122 within the cavity 100C between the support arm 120 and a portion of the body 100B, the damping effect provided by the damping element 130 may be further controlled and improved. In the example depicted in FIGS. 1-4, the stiffening arm 122 extends part way through the cavity 100C from a junction between the sole 108 and the back portion 111 to contact the support arm 120. The support arm 120 and the stiffening arm 122 may each include a metal. In some examples, at least one of the support arm 120 or the stiffening arm 122 may include (e.g., be) a same material as the material of the body 100B of the golf club head 100. For example, at least one of the support arm 120 and the stiffening arm 122 may be integrally formed with the body 100B of the golf club head 100. In some examples, the stiffening arm 122 may be omitted.

In some examples, the damping element 130, the support arm 120, and the stiffening arm 122 may have features similar to features disclosed in U.S. patent application Ser. No. 17/565,895 with reference to elements therein that are respectively similar to the damping element 130, the support arm 120, and the stiffening arm 122. The example damping element 130, support arm 120, and stiffening arm 122 shown in FIGS. 1-4 are not limiting. The one or more damping layers 140 and 150 may also be used without damping element 130 or with different configurations of the damping element, support arm, and stiffening arm, such as those disclosed in U.S. application Ser. No. 17/565,895.

The first constrained damping layer 140 may include a first stiffening plate attached to the interior surface 103I of the striking face 103, and the second constrained damping layer 150 may include a second stiffening plate attached to the interior surface 103I of the striking face 103. The first stiffening plate may include a lightweight material having high strength, and the first stiffening plate may be different in material from at least one of the damping element 130 or the striking face 103. In some examples, the first stiffening plate may include aluminum, any metal capable of being formed into a sheet, carbon fiber, or any other material capable of providing structural rigidity without departing from the scope and content of the present application. The second stiffening plate may include any material that the first stiffening plate may include, and the second stiffening plate may be the same or different in material than the first stiffening plate.

The first stiffening plate may be attached to the interior surface 103I of the striking face 103, for example, by an adhesive between the interior surface 103I of the striking face 103 and a surface of the first stiffening plate facing the interior surface 103I of the striking face 103. The adhesive may include a VHB® tape (e.g., 3M® VHB® tape), a silicone-based adhesive, or a urethane-based adhesive. The second stiffening plate may be attached to the interior surface 103I of the striking face 103 in any manner that the first stiffening plate may be attached to the interior surface 103I of the striking face 103, and the second stiffening plate may be attached to the interior surface 103I of the striking face 103 in a same or different manner (e.g., using a same or different adhesive, respectively) as the manner by which the first stiffening plate is attached to the interior surface 103I of the striking face 103.

In the example depicted in FIGS. 1-4, the first constrained damping layer 140 has one stiffening plate, and the second constrained damping layer 150 has one stiffening plate. However, the present disclosure is not limited thereto. For example, the first constrained damping layer 140 may include two or more stiffening plates arranged in a stack and bonded together, the second constrained damping layer 150 may include two or more stiffening plates arranged in a stack and bonded together, and the number of stiffening plates in the second constrained damping layer 150 may be the same or different from the number of stiffening plates in the first constrained damping layer 140.

The first and second constrained damping layers 140 and 150 may be spaced apart from the damping element 130. In some examples, the first and second constrained damping layers 140 and 150 are spaced apart from each other. At least one of the first constrained damping layer 140 or the second constrained damping layer 150 may be spaced apart from the center (e.g., geometric center) of the striking face 103. The first constrained damping layer 140 may have a first surface 141 facing and attached to the interior surface 103I of the striking face 103 and a second surface 143 opposite to the first surface 141, and the second constrained damping layer 150 may have a first surface 151 facing and attached to the interior surface 103I of the striking face 103 and a second surface 153 opposite to the first surface 151. The first constrained damping element 140 may have an intermediate surface 142 coupled between the first and second surfaces 141 and 143, and the second constrained damping layer 150 may have an intermediate surface 152 coupled between the first and second surfaces 151 and 153.

The second surfaces 143 and 153 of the first and second constrained damping elements 140 and 150, respectively, may face and be exposed to the cavity 100C. The first and second constrained damping elements 140 and 150 may be spaced apart within the cavity 100C from the back portion 111 of the golf club head 100. In some examples, the first and second constrained damping elements 140 and 150 are spaced apart within the cavity 100C from at least one of the sole 108 or the top portion 110, or both.

The first constrained damping layer 140 may be positioned at least partially, or wholly, between the damping element 130 and the toe 102 or between the center of the striking face 103 and the toe 102, and the second constrained damping layer 150 may be positioned at least partially, or wholly, between the damping element 130 and the heel 101 or between the center of the striking face 103 and the heel 101.

The first constrained damping layer 140 may have any suitable shape, such as a disc-shape. In some examples, the first constrained damping layer 140 has a shape corresponding to a shape of a portion of the striking face 103 that the first constrained damping layer 140 is attached to. For example, the first constrained damping layer 140 may have at least one of a lower edge shaped to correspond to a portion of the lower leading edge 104 that the first constrained damping layer 140 is adjacent to, or an upper edge shaped to correspond to a portion of the upper topline edge 105 that the first constrained damping layer 140 is adjacent to. The second constrained damping layer 150 may have any shape that the first constrained damping layer 140 may have, and the second constrained damping layer 150 may have a same or different shape as the first constrained damping layer 140 has. For example, the first constrained damping layer 140 and the second constrained damping layer 150 may each comprise an outer-edge profile that is a quadrilateral shape.

The first and second constrained damping layers 140 and 150 may have any suitable size (e.g., mass, volume, or area), and the first and second constrained damping layers 140 and 150 may be the same or different in size (e.g., same or different in mass, volume, or area). In some examples, the first constrained damping layer 140 may be positioned at least partially, or wholly, on a toe-side portion of the interior surface 103I of the striking face 103 (e.g., a portion, or the entirety, of the interior surface 103I of the striking face 103 between the damping element 130 and the toe 102 or between a center of the striking face 103 and the toe 102), the second constrained damping layer 150 may be positioned at least partially, or wholly, on a heel-side portion of the interior surface 103I of the striking face 103 (e.g., a portion, or the entirety, of the interior surface 103I of the striking face 103 between the damping element 130 and the heel 101 or between a center of the striking face 103 and the heel 101), and the first constrained damping layer 140 may be greater or lesser in area than the second constrained damping layer 150.

In some examples, an area of the first side 141 of the first constrained damping layer 140 may be greater than the first side 151 of the second constrained damping layer 150, or an area of the second side 143 of the first constrained damping layer 140 may be greater or smaller than the second side 153 of the second constrained damping layer. In some examples, an area of the interior surface 103I of the striking face 103 covered or contacted by the first constrained damping layer 140 is 1.0 to 2.0, for example, 1.1 to 1.5, times an area of the interior surface 103I of the striking face 103 covered or contacted by the second constrained damping layer 150. In examples, the first constrained damping layer 140 may cover or contact 30% to 95% of the toe-side portion of the interior surface 103I of the striking face 103, and the second constrained damping layer 150 may cover or contact 30% to 95% of the heel-side portion of the interior surface 103I of the striking face 103. In examples, the toe-side portion of the interior surface 103I of the striking face 103 is the portion of interior surface 103I that is toe-side of an imaginary plane through the geometric center of the striking face 103, wherein the imaginary plane is orthogonal to the longitudinal axis of at least one groove 107. Similarly, the heel-side portion of the interior surface 103I of the striking face 103 is the portion of interior surface 103I that is heel-side of an imaginary plane through the geometric center of the striking face 103, wherein the imaginary plane is orthogonal to the longitudinal axis of at least one groove 107. In examples, the toe-side of portion of the interior surface 103I is larger than the heel-side portion of the interior surface 103I.

In some examples, the damping element 130 is omitted, and the first and second constrained damping layers 140 and 150 are spaced apart from each other on the interior surface 103I of the striking face 103 with nothing on the interior surface 103I of the striking face 103 therebetween. At least a portion (e.g., the entirety) of the interior surface 103I of the striking face 103 between the first and second constrained damping layers 140 and 150 may be exposed to the cavity 100C. In some other examples where the damping element 130 is omitted, the golf club head 100 may include a third constrained damping layer on (e.g., attached to) the interior surface 103I of the striking face 103. The third constrained damping layer may include any material, have any manner of attachment, have any size, and have any shape that the first constrained damping layer 140 may have, and the third constrained damping layer may be the same or different from the first constrained damping layer 140 in at least one of material, manner of attachment, size, or shape. For example, the third constrained damping layer may be greater or smaller in size than at least one of the first constrained damping layer 140 or the second constrained damping layer 150. In some examples, the third constrained damping layer covers or contacts a greater area of the interior surface 103I of the striking face 103 than the second constrained damping layer 150, and the first constrained damping layer 140 covers or contacts a greater area of the interior surface 103I of the striking face 103 than the third constrained damping layer.

The third constrained damping layer may be positioned between the first and second constrained damping layers 140 and 150, and may be spaced apart from at least one of the first constrained damping layer 140 or the second constrained damping layer 150. In some examples, the third constrained damping layer covers the center of the striking face 103. At least a portion of the interior surface 103I of the striking face 103 between the third constrained damping layer and the first constrained damping layer 140, and at least a portion of the interior surface 103I of the striking face 103 between the third constrained damping layer and the second constrained damping layer 150, may be exposed to the cavity 100C.

Each of the first constrained damping layer 140, the second constrained damping layer 150, and the third constrained damping layer may be manufactured by any suitable means, such as by machining or stamping. Certain shapes of the constrained damping layers, such as a disc-shape, may make the constrained damping layers easier to manufacture compared to more complex shapes.

Figure 5:
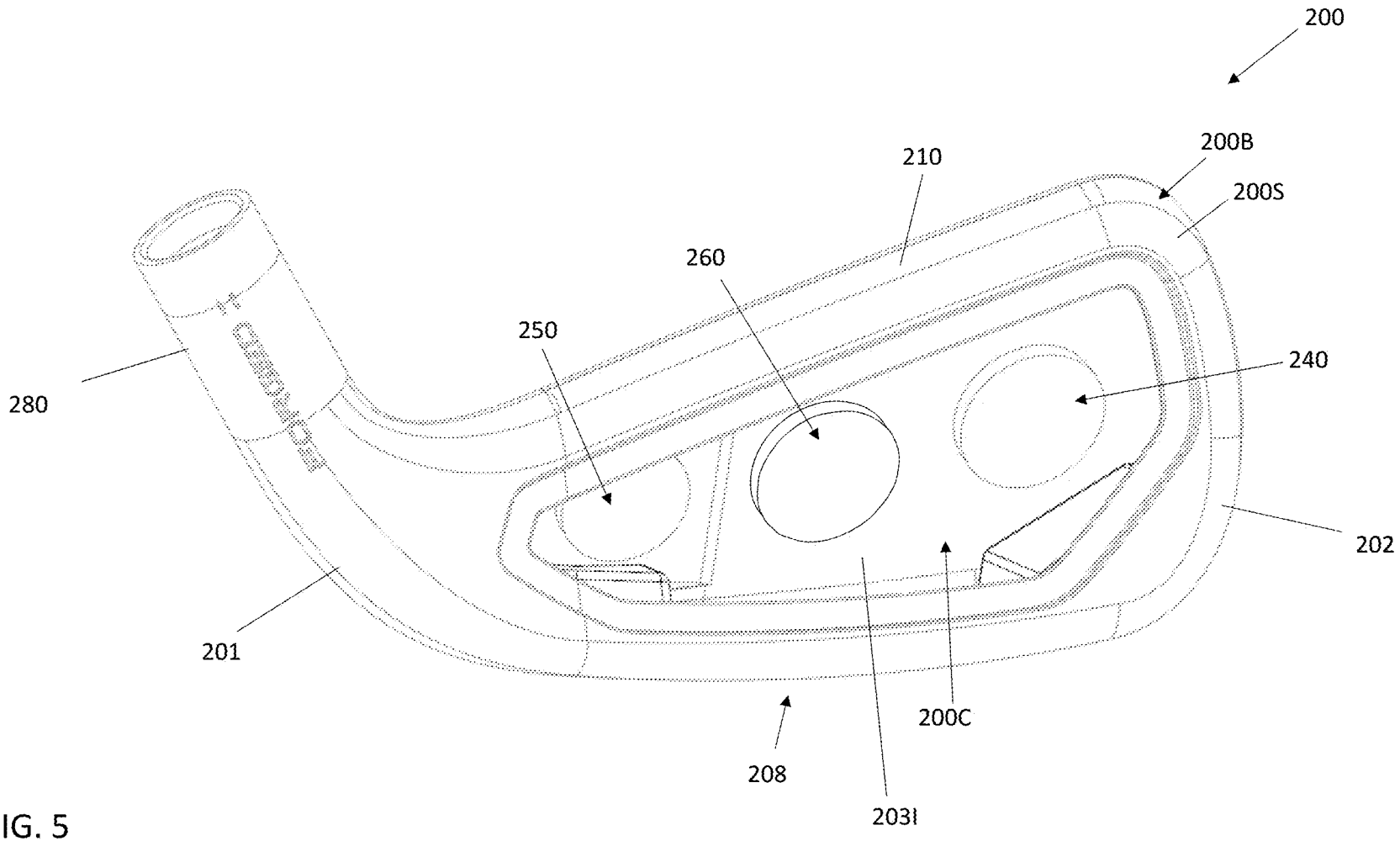
FIG. 5 depicts a back view of another golf club head without part of a back portion of the golf club head according to some examples.

FIG. 5 depicts a back view of another golf club head 200 without part of a back portion of the golf club head 200 according to some examples. In particular, FIG. 5 depicts an iron type golf club head 200.

Referring to FIG. 5, the golf club head 200 may include some features similar to, or the same as, features described and illustrated herein with respect to the golf club head 100 of FIGS. 1-4. The golf club head 200 may include a body 200B having an outer surface 200S. The body 200B may include a heel 201, a toe 202, a striking face coupled between the heel 201 and the toe 202 and having a lower leading edge (not shown) and an upper topline edge (not shown) opposite to the lower leading edge, a sole 208 extending rearward from the lower lead edge, a top portion 210 extending rearward from the upper topline edge, and a back portion (partially omitted from FIG. 5) coupled between the sole 208 and the top portion 210. The body 200B may have a cavity 200C at least partially enclosed by the striking face, the sole 208, and the back portion. The striking face may have an exterior surface facing the outside of the golf club head 200 and an interior surface 203I opposite to the exterior surface of the striking face. For example, the interior surface 203I of the striking face may at least partially face the cavity 200C.

In the depicted example, the golf club head 200 includes a first constrained damping layer 240 on the interior surface 203I of the striking face, a second constrained damping layer 250 on the interior surface 203I of the striking face, and a third constrained damping layer 260 on the interior surface 203I of the striking face. The third constrained damping layer 260 is positioned on the interior surface 203I of the striking face to overlap a center of the striking face, the first constrained damping layer 240 is positioned between the third constrained damping layer 260 and the toe 202, and the second constrained damping layer 250 is positioned between the third constrained damping layer 260 and the heel 201.

Although some examples of a golf club head have been described herein as having one, two, or three constrained damping layers, the present disclosure is not limited thereto. In some examples, a golf club head may include, with or without a damping element, four, five, or six or more constrained damping layers attached to the interior surface of the striking face.

Although specific elements have been recited throughout the disclosure as performing specific functions, one of skill in the art will appreciate that these elements are provided for illustrative purposes, and other devices may be employed to perform the functionality disclosed herein without departing from the scope of the disclosure.

This disclosure describes some embodiments of the present technology with reference to the accompanying drawings, in which only some of the possible embodiments were shown. Other aspects may, however, be embodied in many different forms and should not be construed as limited to the embodiments set forth herein. Rather, these embodiments were provided so that this disclosure was thorough and complete and fully conveyed the scope of the possible embodiments to those skilled in the art.

Further, as used herein and in the claims, the phrase "at least one of element A, element B, or element C" is intended to convey any of: element A, element B, element C, elements A and B, elements A and C, elements B and C, and elements A, B, and C. Further, one having skill in the art will understand the degree to which terms such as "about" or "substantially" convey in light of the measurements techniques utilized herein. To the extent such terms may not be clearly defined or understood by one having skill in the art, the term "about" shall mean plus or minus five percent.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed herein could be termed a second element, component, region, layer or section, without departing from the spirit and scope of the present disclosure.

It will be understood that when an element or layer is referred to as being "on", "connected to", "coupled to", or "adjacent to" another element or layer, it can be directly on, connected to, coupled to, or adjacent to the other element or layer, or one or more intervening element(s) or layer(s) may be present. In contrast, when an element or layer is referred to as being "directly on," "directly connected to", "directly coupled to", or "immediately adjacent to" another element or layer, there are no intervening elements or layers present.

Although specific embodiments are described herein, the scope of the technology is not limited to those specific embodiments. Moreover, while different examples and embodiments may be described separately, such embodiments and examples may be combined with one another in implementing the technology described herein. One skilled in the art will recognize other embodiments or improvements that are within the scope and spirit of the present technology. Therefore, the specific structure, acts, or media are disclosed only as illustrative embodiments. The scope of the technology is defined by the following claims and any equivalents therein.

What is claimed is:

1. A golf club head, comprising:

a striking face having an exterior surface having a lower leading edge and an opposite upper topline edge, and an interior surface opposite to the exterior surface;

a sole extending from the lower leading edge and having a rearward portion opposite to the lower leading edge;

a top portion extending from the upper topline edge;

a back portion coupled between the top portion and the rearward portion of the sole;

a cavity at least partially enclosed by the striking face, the sole, and the back portion;

a support arm extending at least partially through the cavity from at least one of the top portion or the sole;

a damping element positioned between the support arm and the interior surface of the striking face and directly contacting both of the support arm and the interior surface of the striking face; and a first constrained damping layer comprising a metal or a carbon fiber directly attached to the interior surface of the striking face by an adhesive, the first constrained damping layer being spaced apart from the damping element, and a rear surface of the first constrained damping layer being entirely exposed to the cavity.

2. The golf club head of claim 1, further comprising a second constrained damping layer on the interior surface of the striking face and spaced apart from the first constrained damping layer.

3. The golf club head of claim 2, wherein the first constrained damping layer is at least partially positioned between the damping element and a toe of the golf club head, and the second constrained damping layer is at least partially positioned between the damping element and a heel of the golf club head.

4. The golf club head of claim 2, wherein an area of the interior surface of the striking face covered by the first constrained damping layer is 1.1 to 1.5 times an area of the interior surface of the striking face covered by the second constrained damping layer.

5. The golf club head of claim 1, wherein a first surface of the first constrained damping layer opposite to the rear surface faces the interior surface of the striking face.

6. The golf club head of claim 1, wherein the damping element overlaps a center of the striking face.

7. A golf club head, comprising:

a striking face comprising an exterior surface having a lower leading edge and an opposite upper topline edge, and an interior surface opposite to the exterior surface;

a sole extending from the lower leading edge and having a rearward portion opposite to the lower leading edge;

a back portion coupled between the upper topline edge and the rearward portion;

a cavity at least partially enclosed by the striking face, the sole, and the back portion;

a first constrained damping layer comprising a metal or carbon fiber directly attached to the interior surface of the striking face by an adhesive; and a second constrained damping layer spaced apart from the first constrained damping layer and comprising a metal or carbon fiber directly attached to the interior surface of the striking face by an adhesive.

8. The golf club head of claim 7, further comprising a third constrained damping layer on the interior surface of the striking face and spaced apart from the first and second constrained damping layers.

9. The golf club head of claim 8, wherein the third constrained damping layer overlaps a center of the striking face, the first constrained damping layer is at least partially between the third constrained damping layer and a toe of the golf club head, and the second constrained damping layer is at least partially between the third constrained damping layer and a heel of the golf club head.

10. The golf club head of claim 7, wherein the first and second constrained damping layers are each spaced apart within the cavity from the back portion.

11. The golf club head of claim 7, wherein the first and second constrained damping layers each respectively comprises a stiffening plate comprising the metal or carbon fiber and directly attached to the interior surface of the striking face by the adhesive.

12. The golf club head of claim 7, wherein an area of the interior surface of the striking face covered by the first constrained damping layer is different from an area of the interior surface of the striking face covered by the second constrained damping layer.

13. The golf club head of claim 7, wherein a portion of the interior surface of the striking face between the first and second constrained damping layers is exposed to the cavity.

14. A golf club head, comprising:

a body, comprising:

a striking face comprising an exterior surface having a lower leading edge and an opposite upper topline edge, and an interior surface opposite to the exterior surface, a sole extending from the lower leading edge and having a rearward portion opposite to the lower leading edge, and a back portion coupled between the upper topline edge and the rearward portion;

a cavity at least partially enclosed by the striking face, the sole, and the back portion;

a damping layer directly contacting the interior surface of the striking face and covering a center of the striking face, the damping layer comprising a polymer;

a support arm extending at least partially through the cavity from the body, and directly contacting a rear surface of the damping layer; and a constrained damping layer spaced apart from the damping layer, the constrained damping layer comprising a metal or a carbon fiber directly attached to the interior surface of the striking face by an adhesive, and a rear surface of the constrained damping layer being entirely exposed to the cavity.

15. The golf club head of claim 14, wherein a first surface of the constrained damping layer opposite to the rear surface of the constrained damping layer faces the interior surface of the striking face.

16. The golf club head of claim 14, wherein the constrained damping layer comprises a stiffening plate comprising the metal or carbon fiber, the stiffening plate being directly attached to the interior surface of the striking face by the adhesive.

17. The golf club head of claim 16, wherein the stiffening plate comprises aluminum.

18. The golf club head of claim 14, wherein the constrained damping layer is disc-shaped.

19. The golf club head of claim 14, wherein the constrained damping layer has a lower edge shaped to correspond to a portion of the lower leading edge that the constrained damping layer is adjacent to, and an upper edge opposite to the lower edge and shaped to correspond to a portion of the upper topline edge that the constrained damping layer is adjacent to.

20. The golf club head of claim 9, wherein the third constrained damping layer is spaced farther from the sole than the second constrained damping layer, and the first constrained damping layer is spaced farther from the sole than the third constrained damping layer.

* * * * *